US007980307B2

(12) United States Patent
Saylor, III

(10) Patent No.: US 7,980,307 B2
(45) Date of Patent: Jul. 19, 2011

(54) DOWNHOLE WINDOW FINDER SYSTEM

(75) Inventor: James E. Saylor, III, Conroe, TX (US)

(73) Assignee: Smith International, Inc., Houston, TX (US)

( * ) Notice: Subject to any disclaimer, the term of this patent is extended or adjusted under 35 U.S.C. 154(b) by 75 days.

(21) Appl. No.: 12/208,185

(22) Filed: Sep. 10, 2008

(65) Prior Publication Data

US 2010/0059279 A1 Mar. 11, 2010

(51) Int. Cl.
*E21B 23/12* (2006.01)
*E21B 7/08* (2006.01)

(52) U.S. Cl. ..... 166/255.2; 166/255.3; 166/117.5; 166/117.6

(58) Field of Classification Search ..... 166/255.2, 166/255.3, 117.6, 117.5
See application file for complete search history.

(56) References Cited

U.S. PATENT DOCUMENTS

| | | | | |
|---|---|---|---|---|
| 4,926,936 | A * | 5/1990 | Braddick | 166/217 |
| 5,743,331 | A * | 4/1998 | Adkins et al. | 166/55.7 |
| 6,279,659 | B1 * | 8/2001 | Brunet | 166/313 |
| 6,283,208 | B1 | 9/2001 | George et al. | |
| 2003/0150612 | A1 | 8/2003 | McGarian et al. | |

FOREIGN PATENT DOCUMENTS

WO 2010/114699 A1 10/2010

OTHER PUBLICATIONS

U.K. Application No. 0915324.8 Combined Search and Examination Report dated Dec. 18, 2009.
Combined Examination and Search Report issued in corresponding British Patent Application No. GB0915324.8; Dated Dec. 21, 2010 (5 pages).

* cited by examiner

*Primary Examiner* — Giovanna C Wright
(74) *Attorney, Agent, or Firm* — Osha • Liang LLP

(57) ABSTRACT

An apparatus for finding a pre-existing downhole window includes a body having a deflector ramp and a cavity, and an extendable dog disposed in the cavity, the dog mechanically moveable between a retracted position and an extended position into the pre-existing window. In some embodiments, the apparatus includes an axially moveable sleeve disposed adjacent the extendable dog. A downhole window finding apparatus includes a deflector including a window finding assembly, and a running tool removably coupled to the deflector, wherein the window finding assembly includes an extendable member and an axially moveable sleeve retaining the extendable member. In certain embodiments, a fluid flow path extends through the running tool and the deflector to the window finding assembly. In some embodiments, a shear bolt removably couples the running tool to the deflector and includes a fluid passage fluidicly coupling a flow line in the running tool to a flow line in the deflector. A method of finding a pre-existing downhole window is also disclosed.

23 Claims, 18 Drawing Sheets

DOWNHOLE WINDOW FINDER SYSTEM

BACKGROUND

This disclosure relates generally to hydrocarbon exploration and production, and in particular, to forming and managing wellbore tubulars or casings to facilitate hydrocarbon exploration and production.

During hydrocarbon exploration, a wellbore typically traverses a number of zones within a subterranean formation. Wellbore tubing strings or casings are then formed in the wellbore. Openings called windows are also formed in the tubing strings or casings for lateral or horizontal hole operations. The main borehole may then be provided with one or more lateral boreholes which branch from the main borehole and extend into one or more wells laterally displaced therefrom. The window may be formed with a whipstock assembly which is located at the required depth and orientated appropriately so as to laterally deflect a milling tool from the main borehole into the surrounding formation. Alternatively, pre-cut or pre-formed windows can also be used.

In many circumstances a main borehole is known to be provided with a window and a lateral borehole, but the precise depth and orientation of the window is unclear. Proper positioning of downhole equipment (such as a deflector or cleanout assembly) relative to the window is difficult to achieve. Consequential delays in running equipment into a lateral borehole can be highly inconvenient and extremely expensive. Thus, when tripping an apparatus into a lined wellbore with a window cut therein, it is sometimes necessary to locate or find the window. For example, coal bed methane (CBM) lateral wells require periodic reentry to remove accumulated debris from the producing horizontal section. The typical operation includes use of a jetting assembly run on coiled tubing to washout coal fines that have collected inside the slotted liner. One aspect of such an operation may be to locate an existing casing window, position a deflector opposite the window and secure the apparatus in place to enable a washing jet assembly to be guided into the lateral hole. Many other applications for apparatus to be located and secured next to a window also exist.

The principles of the present disclosure are directed to overcoming one or more of the limitations of the existing apparatus and processes for locating a downhole window or other opening in a lined borehole.

SUMMARY

An apparatus for finding a pre-existing downhole window includes a body having a deflector ramp and a cavity, and an extendable dog disposed in the cavity, the dog mechanically moveable between a retracted position and an extended position into the pre-existing window. In some embodiments, the apparatus includes an axially moveable sleeve disposed adjacent the extendable dog. In some embodiments, the sleeve is hydraulically actuatable to release the extendable dog from the retracted position to the extended position. In certain embodiments, the deflector ramp is automatically aligned with a lateral borehole when the extendable dog is in the extended position.

A downhole window finding apparatus includes a deflector including a window finding assembly, and a running tool removably coupled to the deflector, wherein the window finding assembly includes an extendable member and an axially moveable sleeve retaining the extendable member. In some embodiments, the sleeve overlaps and retains the extendable member in a first position, and releases the extendable member in a second position. In certain embodiments, a fluid flow path extends through the running tool and the deflector to the window finding assembly. In some embodiments, a shear bolt removably couples the running tool to the deflector and includes a fluid passage fluidicly coupling a flow line in the running tool to a flow line in the deflector.

A method of finding a pre-existing downhole window includes disposing a deflector including a ramp aligned with an integral extendable dog in a borehole having the pre-existing window, running the deflector to a position near the window, mechanically extending the dog, moving the deflector until the dog sets in the window, and automatically aligning the deflector ramp by setting the dog in the window. In some embodiments, the method includes hydraulically actuating a sleeve to expose and extend the window finder dog. In certain embodiments, the method includes removably coupling a running tool to the deflector, flowing a fluid through the running tool and the deflector to pressurize the sleeve, and actuating the sleeve to release the finder dog. In some embodiments, the method includes shearing the running tool from the deflector and removing the running tool from the borehole. In some embodiments, the method includes re-entering the borehole with the running tool and retrieving the deflector. In other embodiments, the method includes collapsing the finder dog, moving the deflector in the borehole, and re-extending the finder dog to determine at least one of an orientation of the window or a length of the window.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
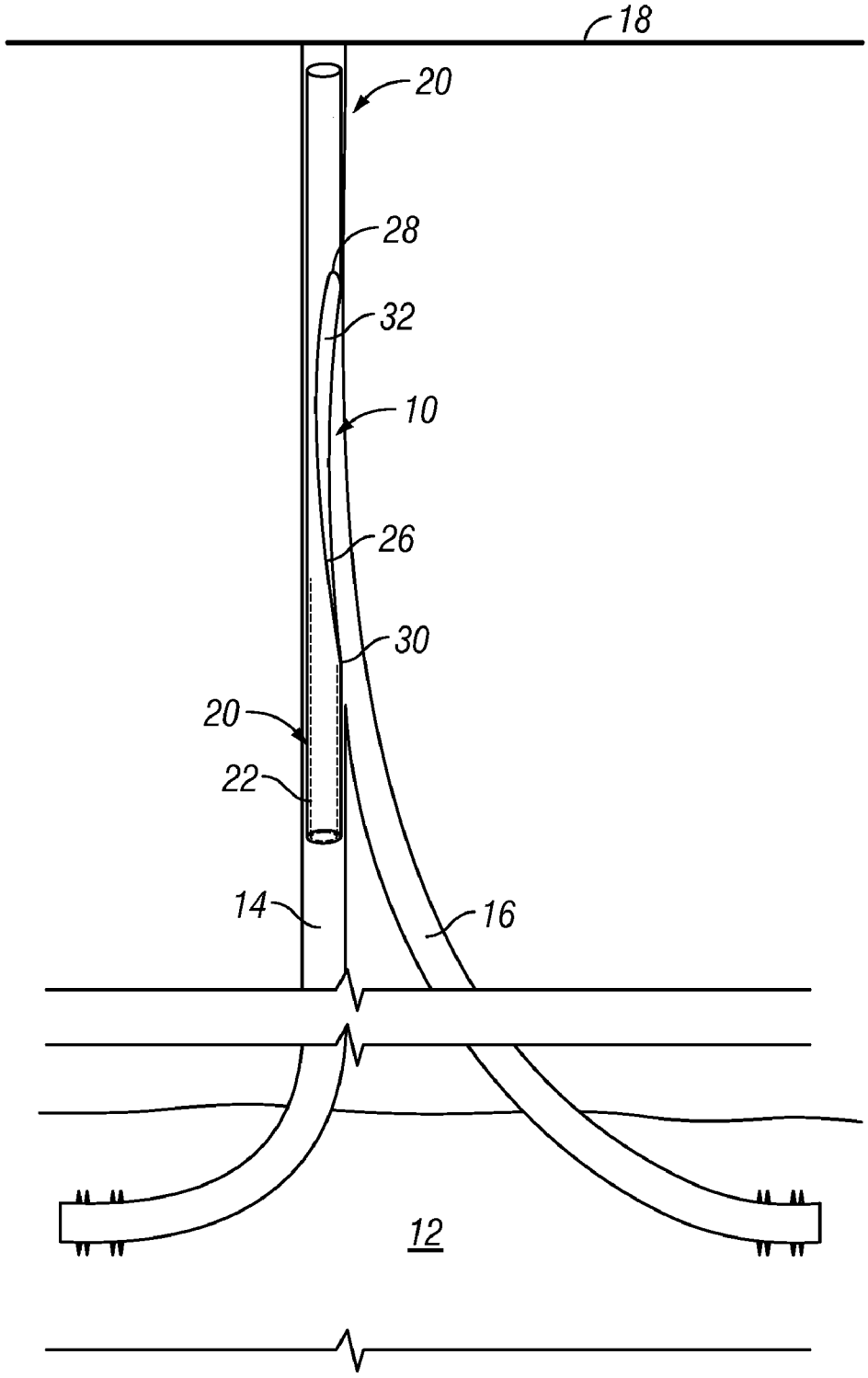
FIG. 1 is a schematic view of a downhole well tubular in a primary borehole having a window directed toward a lateral borehole.

In the drawings and description that follow, like parts are typically marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". The terms "pipe," "tubular member," "casing" and the like as used herein shall include tubing and other generally cylindrical objects. In addition, in the discussion and claims that follow, it may be sometimes stated that certain components or elements are in fluid communication or fluidicly coupled. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Figure 2:
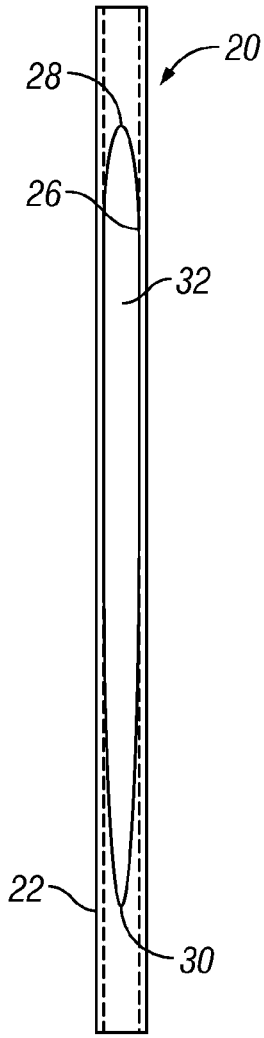
FIG. 2 is a front elevation view of the well tubular and window of FIG. 1.

Referring initially to FIGS. 1 and 2, a primary borehole 14 extends downward from the surface 18 and a lateral borehole 16 extends from a junction 10 with the primary borehole 14 to an earthen hydrocarbon pay zone 12. A downhole well tubular 20, such as a casing joint, is disposed in the primary borehole adjacent the junction 10. The tubular 20 includes a tubular body 22 and a window 26 milled therein. The tubular 20 is oriented in the primary borehole 14 such that the window 26 is directed toward the lateral borehole 16 and an opening 32 defined by the window 26 communicates with the lateral borehole 16. Referring to FIG. 2, the tubular 20 includes the body 22 and the window 26. The window 26 includes an upper end 28 and a lower end 30 defining the opening 32. In some embodiments, the tubular 20 is a casing that is cemented onto the wall of the primary borehole 14.

Figure 3:
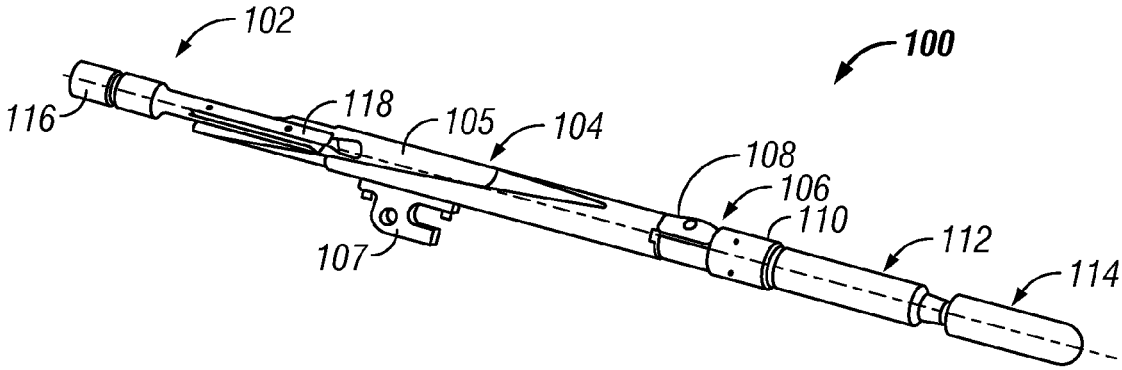
FIG. 3 is a perspective view of an assembled window finder tool in accordance with principles disclosed herein.
Figure 4:
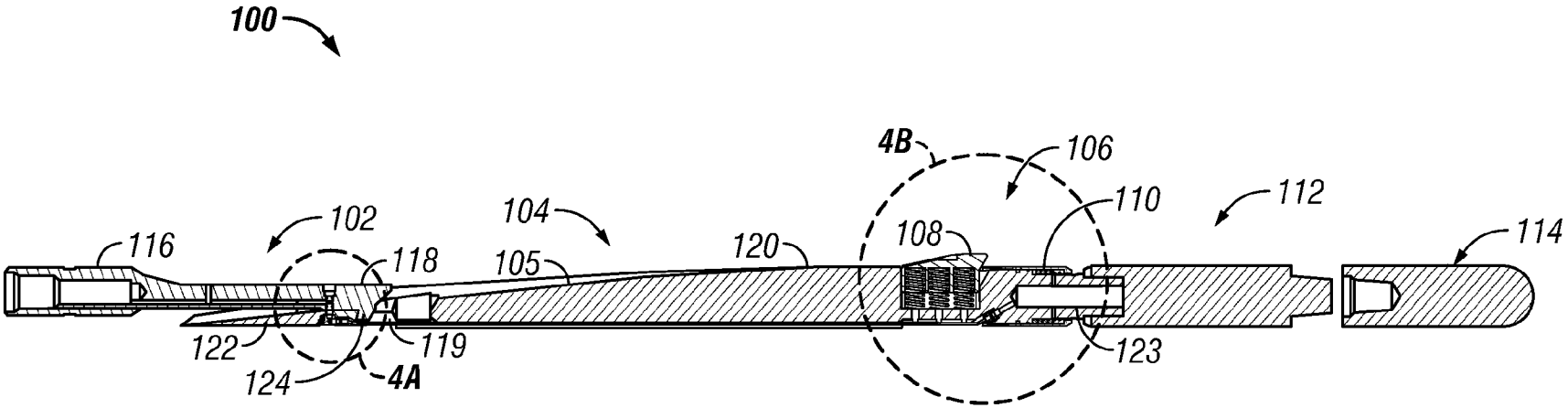
FIG. 4 is a side cross-section view of the window finder of FIG. 3.
Figure 4A:
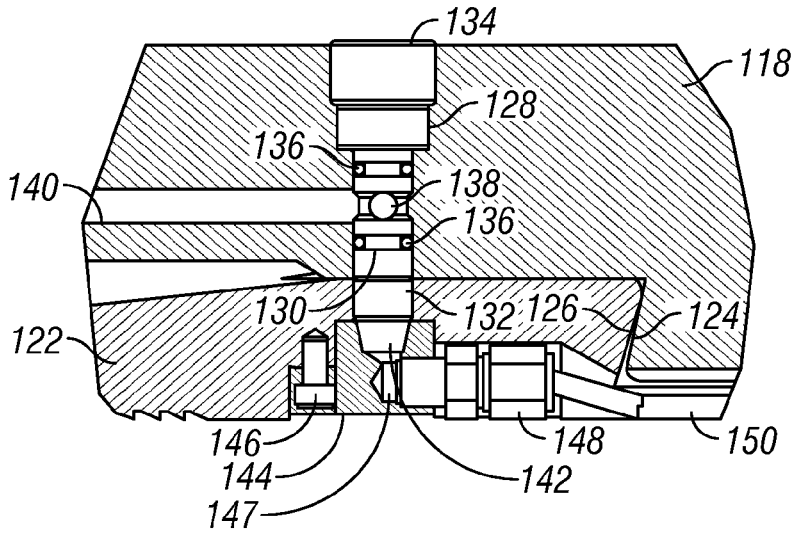
FIG. 4A is an enlarged view of the detail 4A of FIG. 4.
Figure 4B:
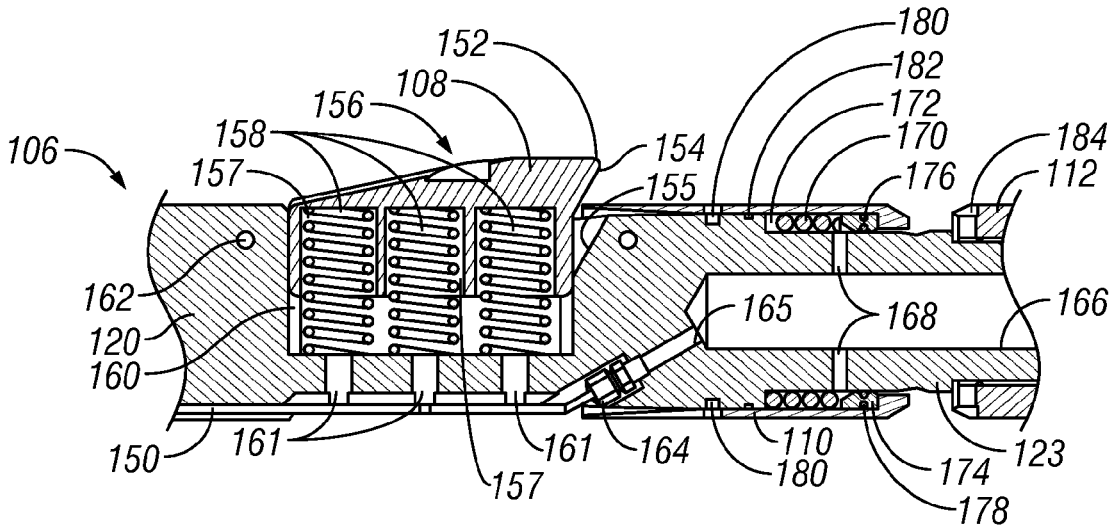
FIG. 4B is an enlarged view of the detail 4B of FIG. 4.

Referring now to FIGS. 3-4B, a tool assembly 100 for locating a window and deflecting other downhole equipment is shown. In FIG. 3, a perspective view of the window finder 100 is shown, including a running and retrieval tool 102, a deflector 104, a window finding assembly 106, a connector 112 and a bull nose 114. In some embodiments, the window finder 100 includes an exterior catline hook 107 for surface handling. Referring also to FIG. 4, an axial cross-section of the window finder 100, the running and retrieval tool 102 includes a coupling or box end 116 for receiving tools or strings above the window finder 100 and a hook end 118. The deflector 104 includes a body 120 having an upper end 122, a lower end 123 and a deflector ramp 105. The upper end 122 includes a slot 119 for receiving the hook end 118 of the running and retrieval tool 102. The lower end 123 supports the window finding assembly 106 having a window finder projection or dog 108 and a retainer sleeve 110. The lower end 123 is coupled to the connector 112, which in turn couples to the removeable bull nose 114.

Referring now to FIG. 4A, detail 4A of FIG. 4 adjacent the hook end 118 of the running and retrieval tool 102 is shown enlarged. The hook end 118 includes an angled hook portion 124 engaging an angled shoulder 126 of the upper end 122 of the deflector 104. The hook end 118 includes an aperture 128 aligned with an aperture 132 in the upper end 122. The aligned apertures 128, 132 receive a shear bolt 130. A plug 134 is affixed in the aperture 128 above the shear bolt 130. A hydraulic block 144 is coupled in the upper end 122 by a screw 146, and includes an inner cavity 147 to receive a lower end 142 of the shear bolt 130. The hydraulic block inner cavity 147 also receives a connector 148 which fluidicly couples to a flow line or conduit 150. The hook end 118 also includes a flow line 140 that fluidicly couples to an aperture 138 in the shear bolt 130. A fluid passage (shown in FIG. 7A) extends between the aperture 138 and the hydraulic block 144, thereby establishing a fluid flow path between the flow lines 140, 150. O-ring seals 136 seal the fluid flow path.

Figure 9:
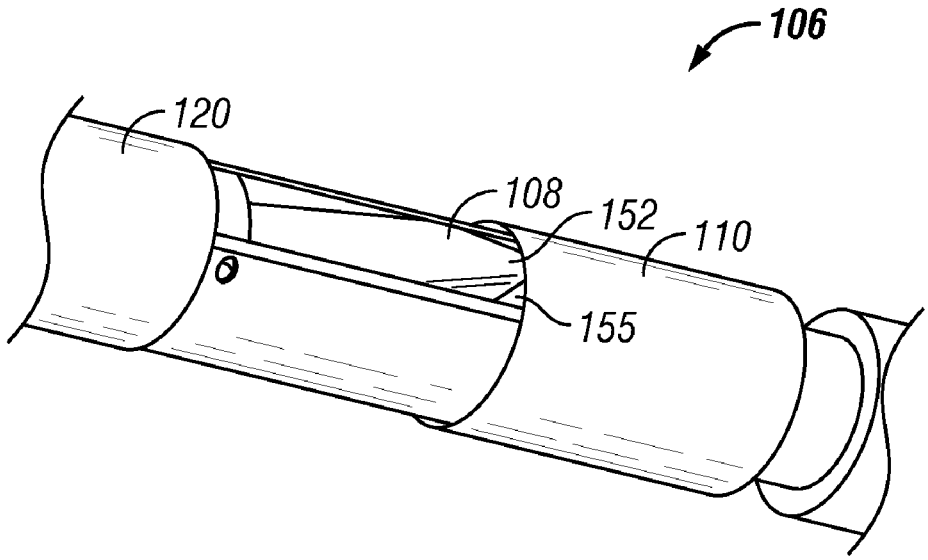
FIG. 9 is the window finding assembly of the window finder of FIG. 3 showing the finder dog and a retainer sleeve in retracted and retained positions.

Referring now to FIG. 4B, detail 4B of FIG. 4 showing the window finding assembly 106 is enlarged. The lower end 123 of deflector body 120 includes a cavity 160 receiving the window finder dog 108. The dog 108 is moveable to be retracted and retained in the cavity 160 and to be projected radially outward in an extended position. For purposes of description, the dog 108 is shown in an extended position even though the sleeve 110 is shown in a retention position wherein the sleeve 110 overlaps the dog 108 to retain it, as is shown in FIGS. 3 and 9. The dog 108 includes an outer portion having a recess 156 and a projection or nose 152 with a load surface 154. An inner portion of the dog 108 includes chambers 157 receiving compression springs 158. In some embodiments, the dog 108 may include more or less chambers receiving a corresponding number of springs. Debris ports 161 extend from the cavity 160. The flow line 150 fluidicly couples to a connector 164, which couples to a fluid passage 165 and then to a fluid chamber 166. Fluid passages 168 extend into a fluid chamber 172 created by the sleeve 110 being reciprocally disposed about the lower end 123. A compression spring 170 and a piston 174 are disposed in the chamber 172. A series of O-ring seals 176, 178, 182 seal the chamber 172. Shear screws 180 couple the sleeve 110 to the lower end 123. The connector 112 is coupled to the lower end 123 and includes sockets 184 for receiving set screws.

Figure 5:
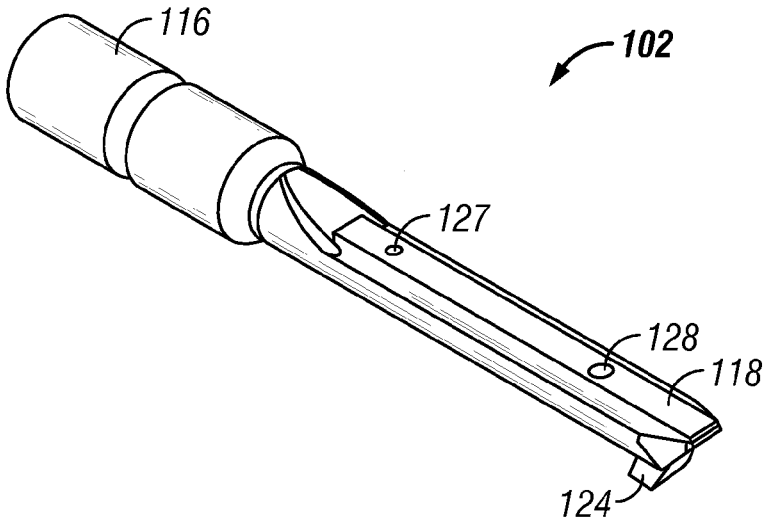
FIG. 5 is a perspective view of the running and retrieval tool of the window finder of FIG. 3.
Figure 5A:
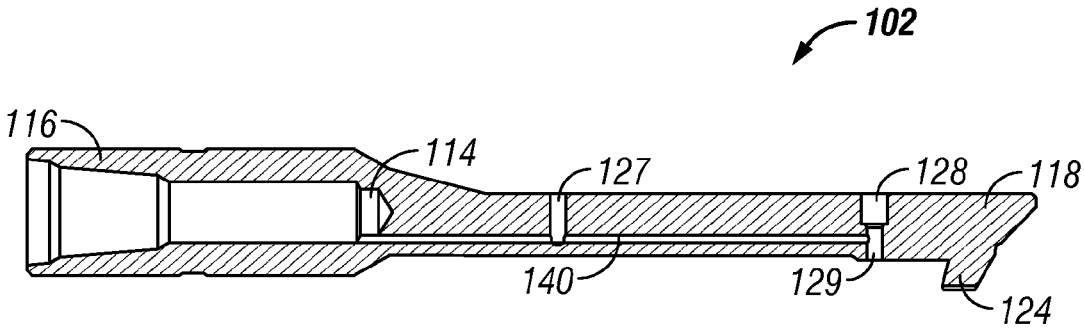
FIG. 5A is a side cross-section view of the running and retrieval tool of FIG. 5.
Figure 5B:
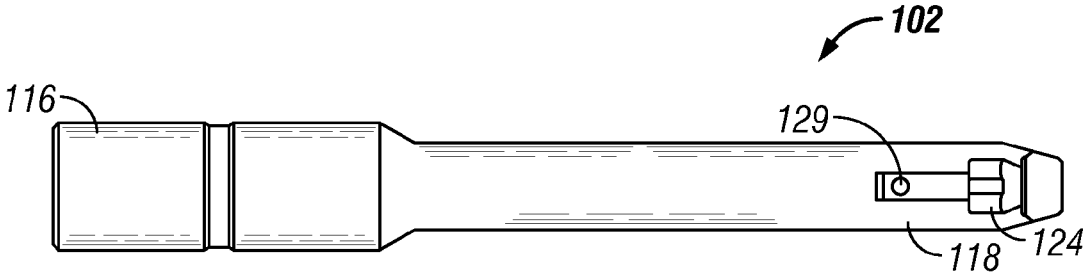
FIG. 5B is a bottom view of the running and retrieval tool of FIG. 5.

Referring now to FIG. 5, the running and retrieval tool 102 is shown separated from the window finder 100. The perspective view of FIG. 5 shows the coupling or box end 116 and the hook end 118 having the hook 124, the shear bolt aperture 128 and an additional aperture 127. The side cross-section view of FIG. 5A shows that the flow line 140 fluidicly couples the aperture 128 and a port 129 to a receptacle 141 in the box end 116. The aperture 127 may also couple to the flow line 140. The aperture 127 may also be provided with a tapered thread, or a national pipe thread tapered (NPT), to receive a bolt or screw. Similarly, the aperture 128 may also be provided with a NPT. The bottom view of FIG. 5B shows the running and retrieval tool 102 provided with the hook 124 and the port 129 at the hook end 118.

Figure 6:
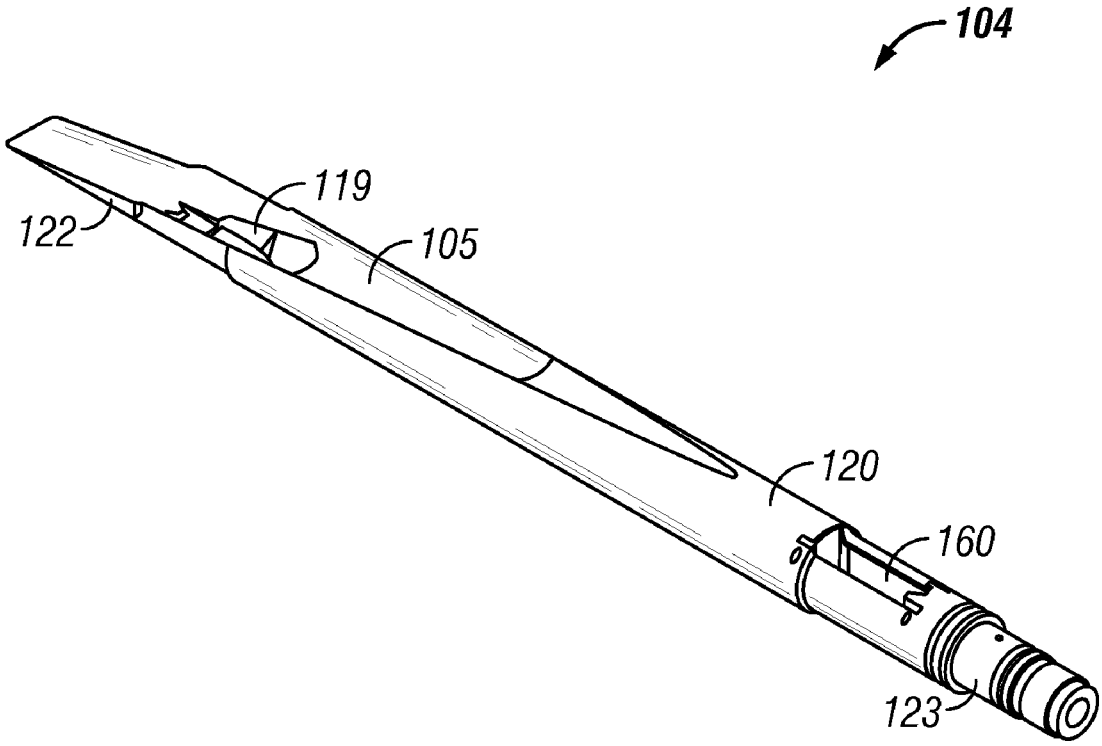
FIG. 6 is a perspective view of the deflector of the window finder of FIG. 3.
Figure 6A:
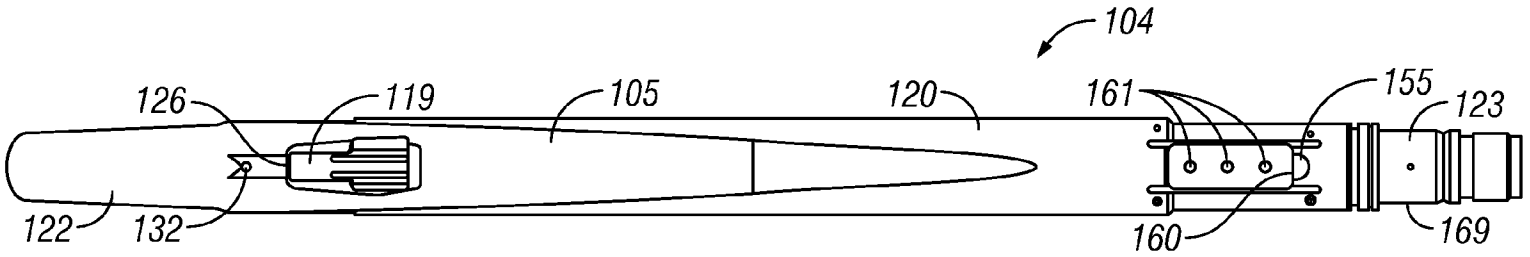
FIG. 6A is a top view of the deflector of FIG. 6.
Figure 6B:
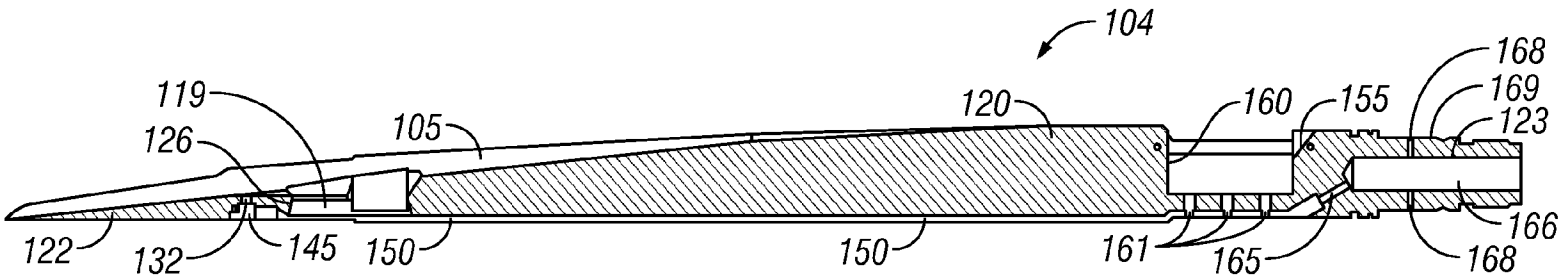
FIG. 6B is a side cross-section view of the deflector of FIG. 6.
Figure 6C:
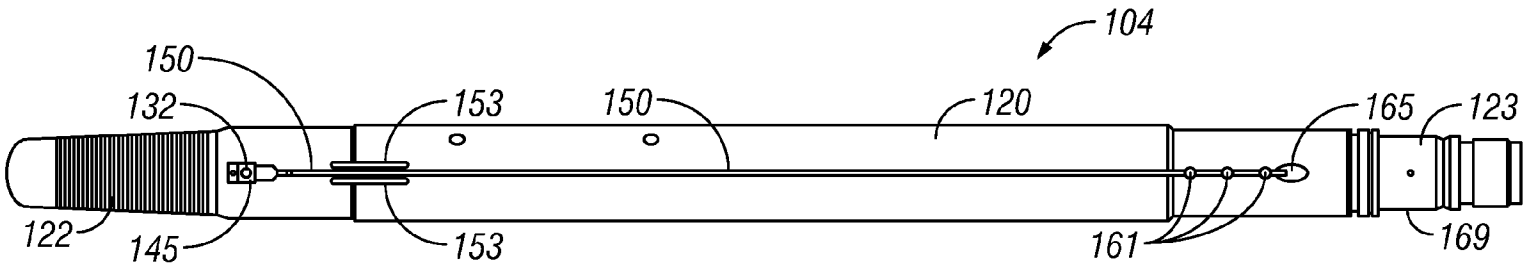
FIG. 6C is a bottom view of the deflector of FIG. 6.

Referring next to FIG. 6, the deflector 104 is shown separated from the window finder 100. The perspective view of FIG. 6 shows the deflector body 120 having the upper end 122, the lower end 123 and the deflector ramp 105. The upper end 122 includes the hook slot 119 formed into the ramp 105 surface for receiving the hook 124. The lower end 123 includes the cavity 160. The top view of FIG. 6A shows the hook slot 119, the angled shoulder 126 and the aperture 132 that engage the underside of the hook end 118 as shown in FIG. 4A. Also, the cavity 160 includes the debris ports 161 and an angled surface or chamfer 155. The lower end 123 includes a reduced diameter portion 169. The side cross-section view of FIG. 6B shows that the axial flow line 150 fluidicly couples a receptacle 145 and the aperture 132 to the fluid passage 165. The fluid passage 165 communicates with the fluid chamber 166 having fluid passages 168. The bottom view of FIG. 6C shows the axial flow line 150 in the deflector 104 providing a fluid flow path between the receptacle 145 and the aperture 132 and the fluid passage 165. The deflector 104 also includes debris ports 153 for communicating debris from the hook slot 119 and the ramp 105 to the back side of the deflector 104.

Figure 7:
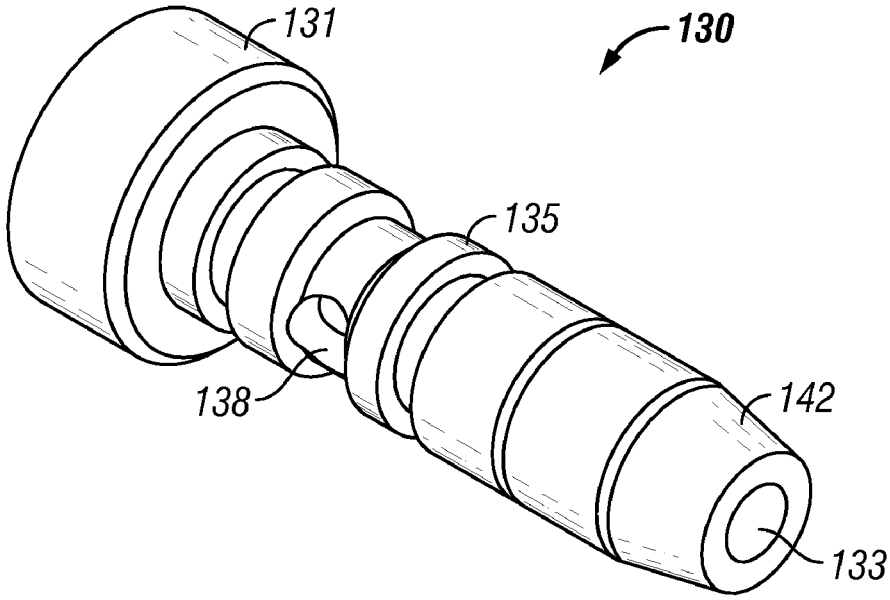
FIG. 7 is a perspective view of the shear bolt of the window finder of FIG. 4.
Figure 7A:
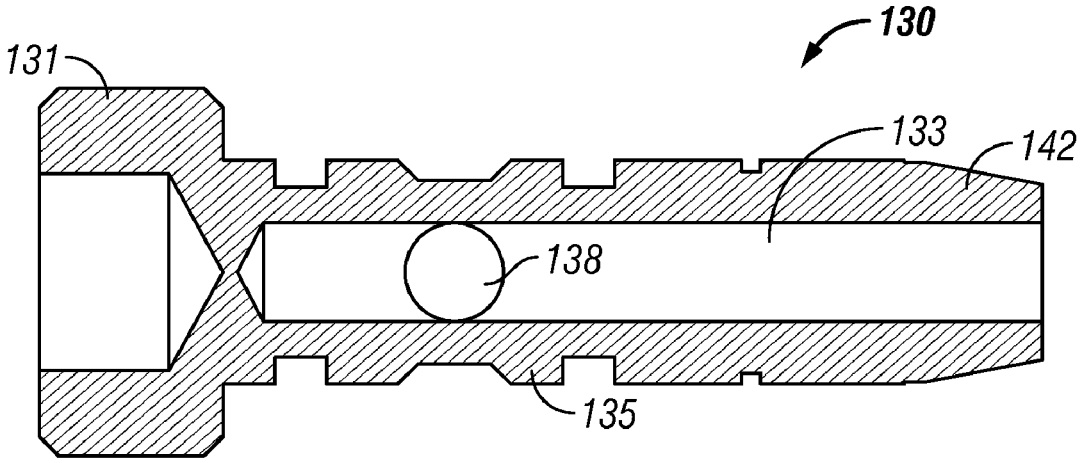
FIG. 7A is a side cross-section view of the shear bolt of FIG. 7.

Referring now to FIG. 7, the shear bolt 130 is shown separated from the connection between the running tool 102 and the deflector 104 (FIG. 4A) of the window finder 100. The perspective view of FIG. 7 shows the shear bolt 130 including an upper head portion 131, a lower threaded portion 142 and an intermediate portion 135 including the aperture or fluid port 138. In exemplary embodiments, the threaded portion 142 includes a NPT that threadably engages the NPT of a threaded opening in the hydraulic block 144, as shown in FIG. 4A. As shown in the longitudinal cross-section view of FIG. 7A, the fluid port 138 fluidicly couples to an axial fluid passage 133 to provide a fluid flow path through the shear bolt 130.

Figure 8:
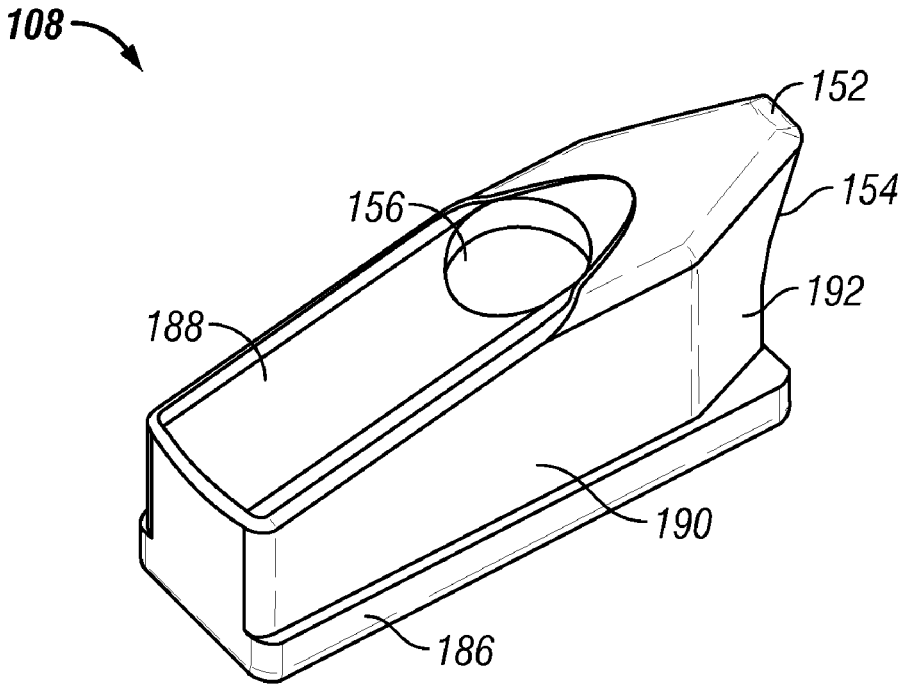
FIG. 8 is a perspective view of the dog of the window finder of FIG. 3.

Referring now to FIG. 8, the dog 108 is shown separated from the window finding assembly 106 (FIGS. 4 and 4B) of the window finder 100. The perspective view of FIG. 8 shows the dog 108 including a base portion 186, a top surface 188 and a body portion 190. In some embodiments, the top surface 188 is angled relative to the base portion 186 and includes the recess 156. The body 190 includes a full width portion and a tapered end portion 192 including tapered sides that extend to the nose 152 and the end load surface 154.

In operation, the window finder 100 is first assembled as shown in FIGS. 3-4B. The running/retrieval tool 102 is coupled to deflector 104 by engaging the hook 124 in the hook slot 119 and inserting the shear bolt 130 into the aligned apertures 128, 132. The threaded end 142 is secured into the hydraulic block 144. The plug 134 is affixed over the shear bolt 130. The fluid flow line 140 communicates with the cavity 147 in the hydraulic block through the port 138 and fluid passage 133 in the shear bolt 130. In this manner, the tool 102 is fluidicly coupled to the deflector 104 to provide a first fluid flow path therethrough. The fluid flow path continues though the connector 148 and flow line 150 to the window finding assembly 106. The flow line 150 then couples to another fluid flow path provided by the connector 164, the fluid passage 165, the fluid chamber 166, the fluid passages 168 and the fluid chamber 172 (see FIG. 4B). The sleeve 110 is secured into a first or retention position by the shear screws 180, thereby compressing the spring 170. Though the dog 108 is shown extended in FIG. 4B for illustrative purposes, the dog 108 is actually retracted and retained by the sleeve 110 in the assembled or run-in position as shown in FIGS. 3 and 9. In FIG. 9, the dog 108 is retained by overlapping an end portion of the sleeve 110 with the nose 152 of the dog 108 and securing the nose 152 in the chamfer 155. The springs 158 are thereby compressed. In some embodiments, the connector 112 and a weighted bull nose 114 are coupled to the lower end of the tool 100.

Figure 10:
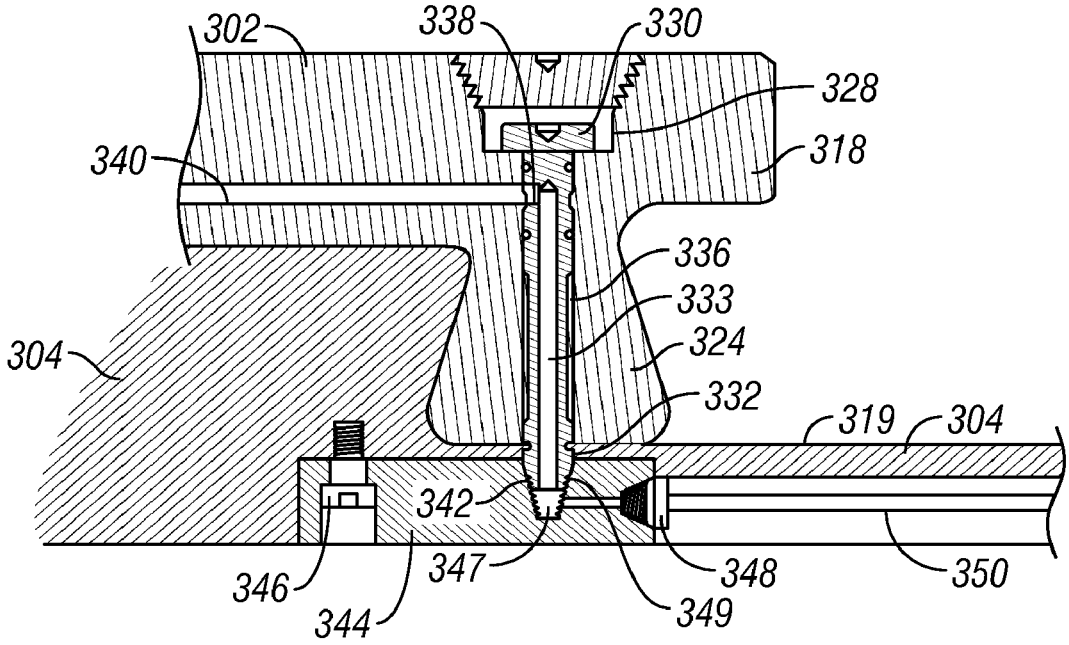
FIGS. 10 and 10A depict an alternative embodiment of the hook and shear bolt assembly of FIG. 4A.
Figure 10A:
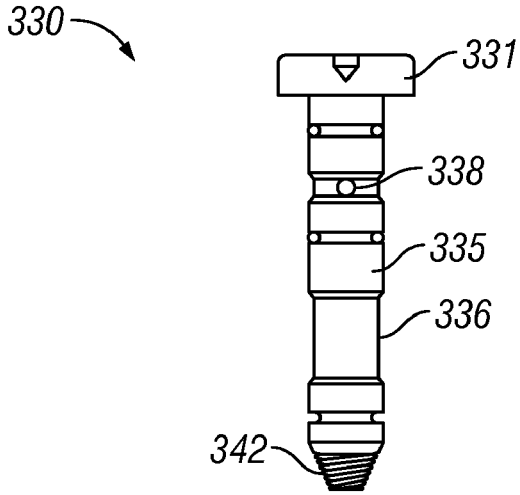

In an exemplary alternative embodiment, the fluidic coupling between a running/retrieval tool 302 and a deflector 304 is provided as shown in the cross-section view of FIG. 10. A hook 324 of a hook end 318 is engaged in a hook slot 319 of the deflector 304. Instead of inserting a shear bolt axially spaced above the hook, as shown in FIG. 4A, a shear bolt 330 is inserted into an aperture 328 extending through the hook 324. The shear bolt 330 further extends into an aperture 332 in the deflector 304, and a threaded end 342 secures to a NPT in an aperture 349 in a hydraulic block 344. The hydraulic block 344 is secured to the deflector 304 by a screw 346, and includes a cavity 347. A connector 348 couples a fluid flow line 350 to the hydraulic block 344. With reference to FIGS. 10 and 10A, the shear bolt includes an upper head portion 331, an intermediate portion 335 and the lower threaded end 342. The intermediate portion 335 includes a fluid port 338 and a reduced diameter portion 336 to provide outer diameter relief in the aperture 328. The fluid port 338 couples to an axial fluid passage 333. In the assembled position as shown, a fluid flow line 340 in the tool 302 fluidicly couples to the port 338 and the fluid passage 333, which couples to the cavity 347 and ultimately to the flow line 350. In this manner, an alternative fluid flow path is provided between the connected running/retrieval tool and the deflector.

In some embodiments, in addition to making up the window finder 100 into the run-in position as just described, the tool is filled with clean water such that the fluid flow paths, chambers and cavities as previously described are occupied with water. In an exemplary embodiment, the window finder 100 includes a float valve to ensure hydraulic integrity.

The window finder 100 is disposed in a borehole, such as the borehole 14 of FIG. 1, in the run-in position of FIG. 3 with the sleeve 110 in the retention position and the dog 108 in the retracted position as shown in FIG. 9. The retracted dog 108 will be prevented from snagging on edges or other obstructions in the borehole 14. The window finder 100 is lowered to a position near the pre-existing window 26. In an exemplary embodiment, the window finding assembly 106 is positioned below the pre-existing window 26 such that the dog 108 is below the lower end 30 of the window 26. In another exemplary embodiment, the window finding assembly 106 is positioned above the lower end 30. Next, a predetermined pressure is applied to the tool 100. The predetermined pressure is applied in known ways, such as by a pump or other tool connected above the window finder 100. The pump is activated and the fluid pressure is communicated through the flow line 140, the shear bolt 130, the flow line 150 and to the fluid chamber 166. A previously noted, the fluid may be clean water or other known hydraulic fluids. The fluid pressure is communicated to the fluid chamber 172 through the fluid passages 168, with the predetermined pressure being sufficient to shear the screws 180 with assistance from the force provided by the spring 170.

Figure 11:
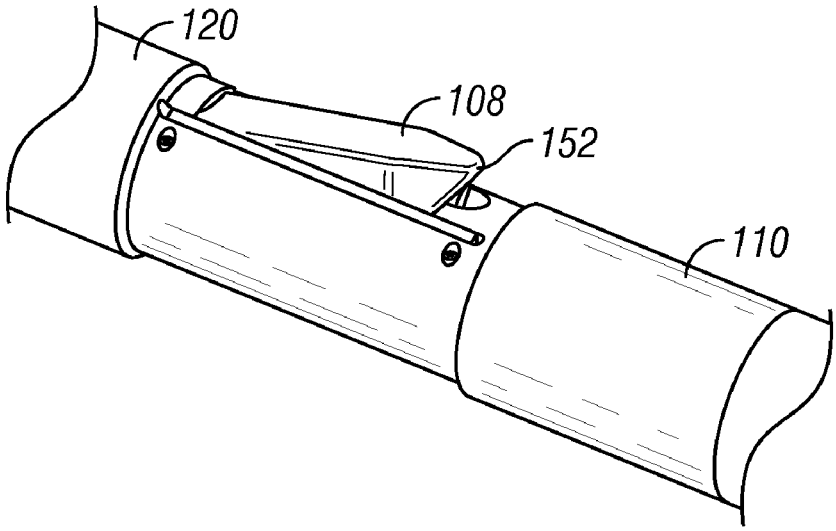
FIG. 11 is the window finding assembly of FIG. 9 shown in a released and extended position.

With reference now to FIG. 11, the shearing of the screws 180 removes axial resistance on the sleeve 110, allowing the piston 174 to pump down on the sleeve 110. The spring 170 also provides a force to translate the sleeve 110 axially downward or away from the dog 108, thereby exposing the nose 152 and allowing the dog 108 to expand or project radially outward as shown. The dog 108, once released from the sleeve 110, is force radially outward by the springs 158. In exemplary embodiments, the cavity 160 may also be pressurized by communicating pressurized fluid from the flow line 150. Once the sleeve 110 is moved from the retention position to the release position, and the dog 108 is extended, the pump may be deactivated to pressure down the tool 100.

Figure 12:
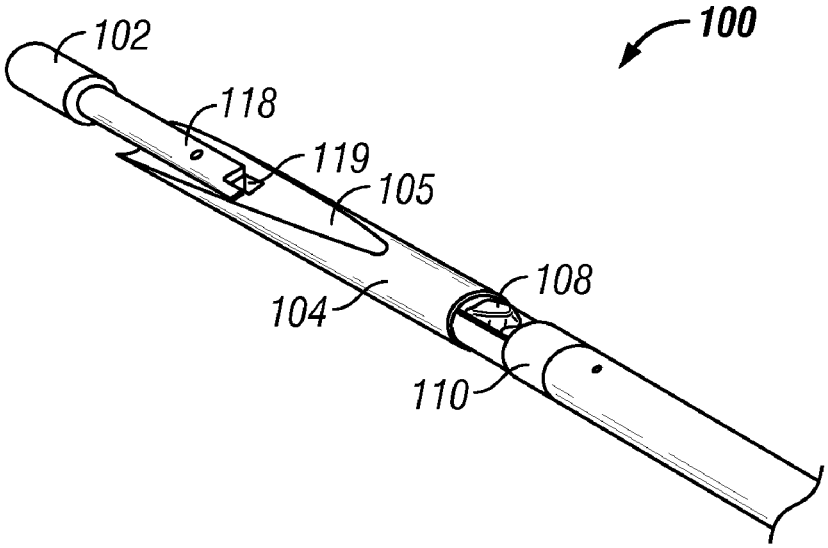
FIG. 12 is the window finder of FIG. 3 shown in a window locating position.
Figure 12A:
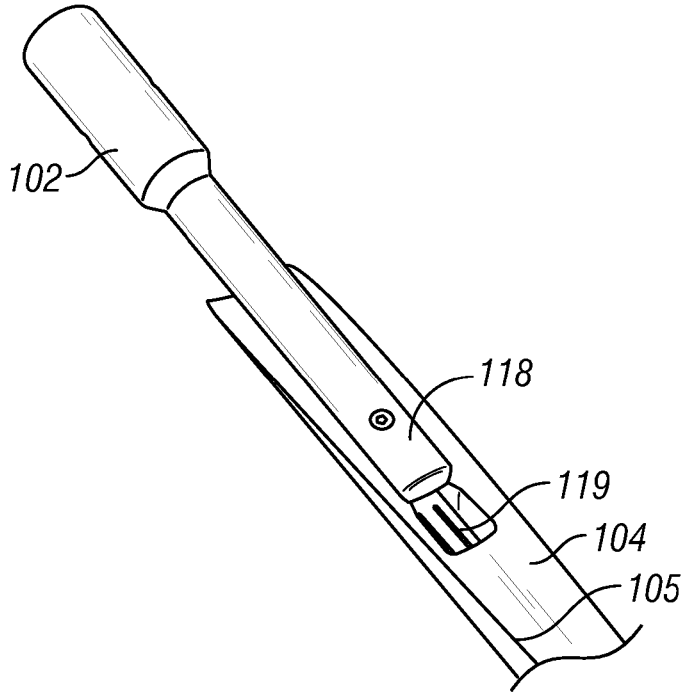
FIG. 12A is an enlarged view of the hook and hook slot portion of the window finder of FIG. 12.

The window finder 100 is now ready to locate the pre-existing window 26. Referring to FIGS. 12 and 12A, the running tool 102 is coupled to the deflector 104 having the integral finder dog 108 that is mechanically biased radially outward by the springs 158. In FIG. 12A, the running tool 102 is shear coupled to the upper portion of the hook slot 119 while the lower portion is exposed as shown. Then, using tubing or another conveyance coupled above the tool 100 as is known, the tool 100 is pulled upward in the borehole 14 while also rotating the tool 100. Thus, while moving axially toward the lower end 30 of the window 26, the dog 108 will also index to the window 26 due to the rotation. An increase in torque in the tool 100 and the conveyance will indicate when the dog 108 has projected into and engaged the window 26. In exemplary embodiments, the tool 100 is lowered while rotating if the dog 108 is positioned above the lower end 30, and the dog 108 is indexed in a downward axial motion.

Figure 13:
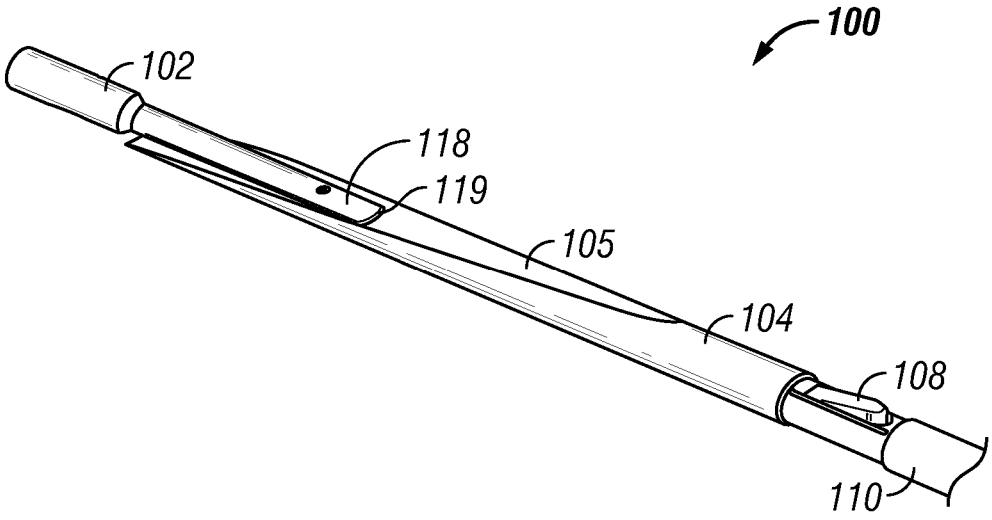
FIG. 13 is the window finder of FIG. 12 shown in a weighted position wherein the shear bolt is sheared to move the hook downward in the hook slot.

Next, the window finder 100 is lowered to set the dog 108 in the lower end 30 of the window 26. The tapered end portion 192 of the dog 108 (see FIG. 8) having the focused load surface 154 and the nose 152 roughly matches the arcuate profile of the lower end 30 of the window 26. The mating shapes of the dog 108 and the end 30 of the window 26 provides stability at the connection between the finder dog 108 and the window 26. A predetermined weight is now applied to the tool 100 in a downward direction. The weight is predetermined based on the shear bolt 130, 330. Referring now to FIG. 13, the applied weight will shear the bolt 130, 330 and cause the running tool 102 to move downward in the hook slot 119 to occupy the lower portion of the hook slot shown in FIGS. 12 and 12A. The applied set-down weight will also indicate that the dog 108 is set or wedged in the lower end 30 of the window 26, and that the corresponding matching profiles are engaged.

Figure 14:
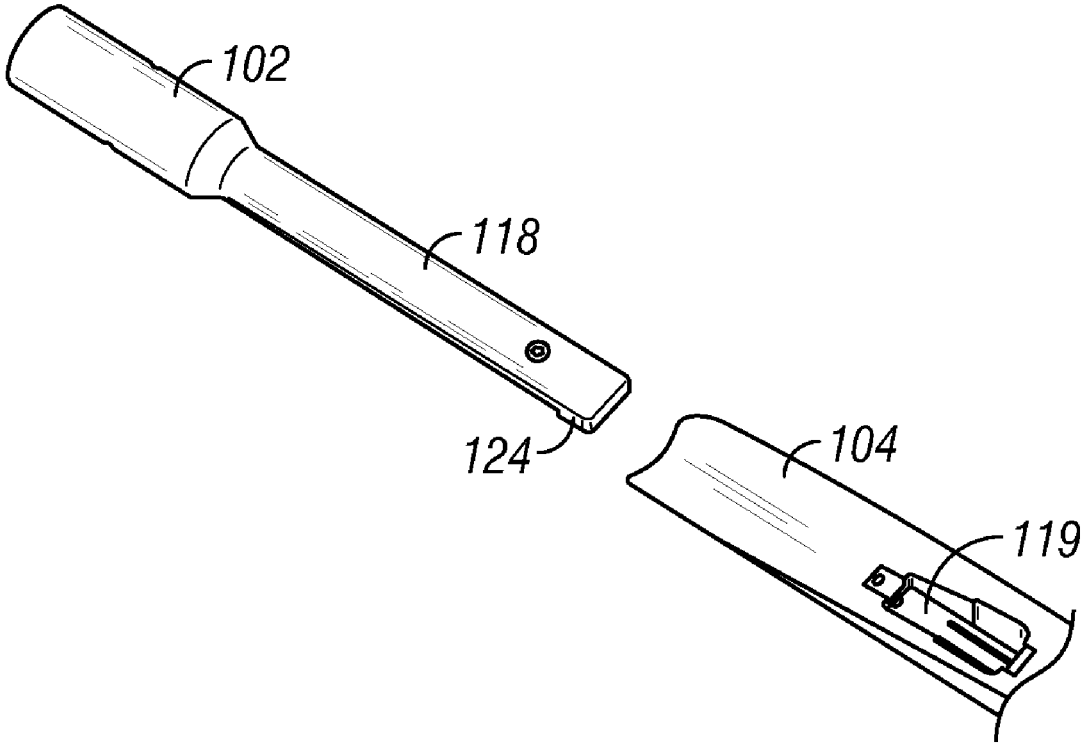
FIG. 14 is the window finder of FIG. 13 wherein the running and retrieval tool is released.

Referring to FIG. 14, the running tool 102 may be rotated to release the hook 124 from the hook slot 119. The running tool 102 may be pulled upward out of the borehole 14, removing the running tool 102 and leaving the deflector 104 with the integral window finding assembly 106 in the borehole adjacent and engaged with the window 26. Because the dog 108 is aligned with the ramp 105 of the deflector 104, the ramp 105 is aligned with the lateral borehole 16 for successfully directing additional tools into the lateral borehole. For example, accumulated debris may need to be removed from the producing section 16. A jetting assembly run on coiled tubing may be lowered into the borehole 14. The jetting assembly will engage the aligned and stabilized deflector 104 and be guided into the lateral hole 16, where the jetting assembly may washout coal fines that have collected inside the slotted liner. Other tools and downhole equipment may be used in this manner with the integral deflector and window finder 100.

After the washout process or other ancillary operation is complete, the running/retrieval tool 102 is lowered back into the borehole 14 to the deflector 104. When the retrieval tool 102 has reached the deflector 104, it is rotated to re-engage the hook 124 with the hook slot 119. The deflector 104 may then be pulled out of the borehole 14. The angled top surface 188 of the dog 108 (see FIG. 8) will facilitate movement of the deflector 104 through the borehole. Any obstruction, such as the upper end 28 of the window 26, will engage the angled surface 188 and slide along it, thereby providing a radially inward collapsing force to the dog 108.

In some embodiments, the collapsibility of the dog 108 due to applying reaction forces on the top angled surface 188 of the dog 108 will allow the operator to remove the dog 108 from the window 26 and re-enter the window 26 in the same trip into the borehole by manipulating the conveyance string. A window's orientation may be determined by rotating the string, collapsing the dog and removing it from the window, continuing to rotate the string, and re-extending the dog and to re-insert it into the window. Axial movement of the dog may also accompany such operations. Such axial movement, along with collapsing and re-extending the dog, may also be used to determine the axial length of the window.

Figure 15:
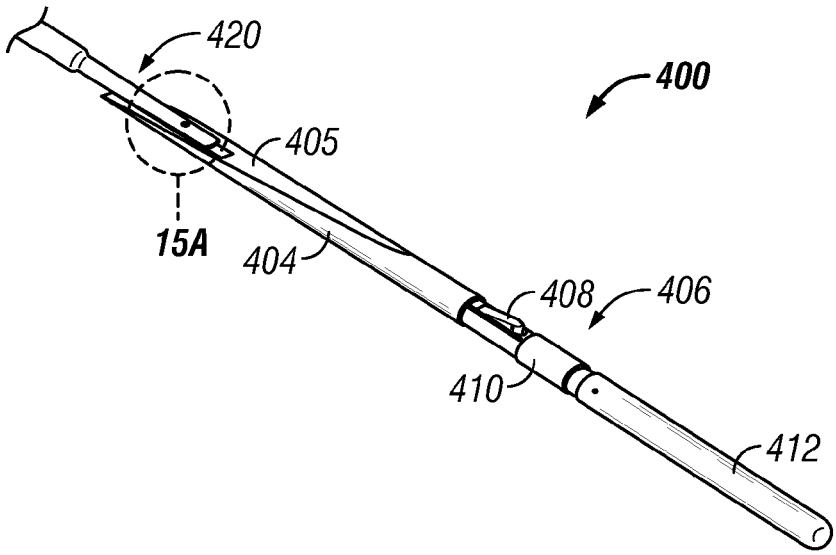
FIG. 15 is a perspective view of an alternative embodiment of a one-trip window finder system including an operating tool.

In exemplary embodiments, the washout or other tool may be coupled to the window finder 100 to provide a one-trip system. With reference to FIG. 15, a one-trip system 400 includes a deflector 404 having an integral window finding assembly 406 and an operating tool 420. The window finding assembly 406 includes a retractable sleeve 410 and extendable finder dog 408, consistent with the teachings herein. An operating tool 420, such as a washout tool, is removably coupled to the deflector 404 at a hook slot in a ramp 405. The washout tool 420 is fluidicly coupled to the deflector 404 (as shown in the enlarged cross-sectional detail of FIG. 15A) and can be released to allow the tool 420 to slide down the located deflector 404 and into the lateral borehole.

Figure 15A:
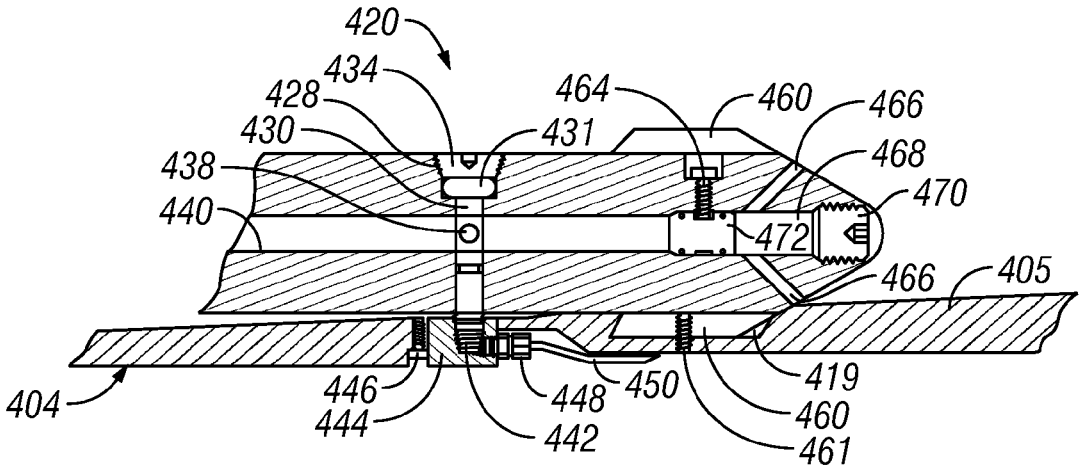
FIG. 15A is an enlarged, side cross-sectional view of detail 15A of FIG. 15.

Referring now to FIG. 15A, the washout tool 420 includes an aperture 428 receiving a shear bolt 430 coupling the washout tool 420 to the deflector 404, similar to other embodiments herein. The shear bolt 430 includes a head 431 and a threaded end 442 coupled into a hydraulic block 444. The hydraulic block 444 is coupled to the deflector 404 by a screw 446. The hydraulic block 444 is fluidicly coupled to a flow line 450 by a connector 448. The shear bolt 430 includes a port 438 and an internal fluid passage (not shown, but similar to fluid passages 133, 333) creating a fluid flow path from a fluid passage 440 in the washout tool 420, through the shear bolt 430 and the hydraulic block 444, and finally to the flow line 450. A pipe plug 434 may cover the shear bolt 430.

The operating end of the washout tool 420 includes fluid ports 466 for the washout process and a blade 460 positioned in a hook slot 419 in the deflector ramp 405. An upper blade 460 opposite the engaged blade 460 is shown for clarity in viewing the blade. The blade 460 positioned in the hook slot 419 locks into the hook slot 419 using a similar dovetail configuration as shown and described herein, and is further retained by a shear pin 461. A piston 472 is shouldered against the fluid passage 440 having a diameter slightly less than the diameter of a fluid passage 468. The piston 472 is retained by a shear pin 464. The fluid passage 468 communicates with the fluid ports 466 and is capped by a pipe plug 470 threaded into an end portion of the fluid passage 468. The shear pin 464 for the piston 472 is able to resist the fluid pressurization used to hydraulically release/retract the sleeve 410 and extend the dog 408, thereby isolating the fluid ports 466 during the dog release process. This will ensure hydraulic continuity while the tool 400 is pressurized to release the dog 408, and prevent premature actuation of the washout tool 420. After the dog 408 is hydraulically released and extended, and a window location indication is received, a higher fluid pressure is provided through the washout tool 420 to shear the pin 464 and release the piston 472. As the piston 472 then axially traverses the fluid passage 468 and passes the fluid ports 466, the ports 466 will be opened to fluid communication in the passage 468 and the washout process will begin. Simultaneously, a set-down weight applied to the tool 400 will shear the bolt 430 and the pin 461. The blade 460 is contoured to kick the washout tool 420 out of the hook slot 419 so that the tool 420 will slide down the deflector ramp 405, through the window, and into the lateral borehole.

In various embodiments, the end connectors 112, 114, 412 are used to centralize the tool and provide torque and weight balancing in the borehole. Additional connectors 112 or drill collars may be added to the tool to provide additional length or weight. The added weight may assist with set-down actions or weight indications of the tool. The end connector may be one component (412) or multiple components (112, 114).

Figure 16:
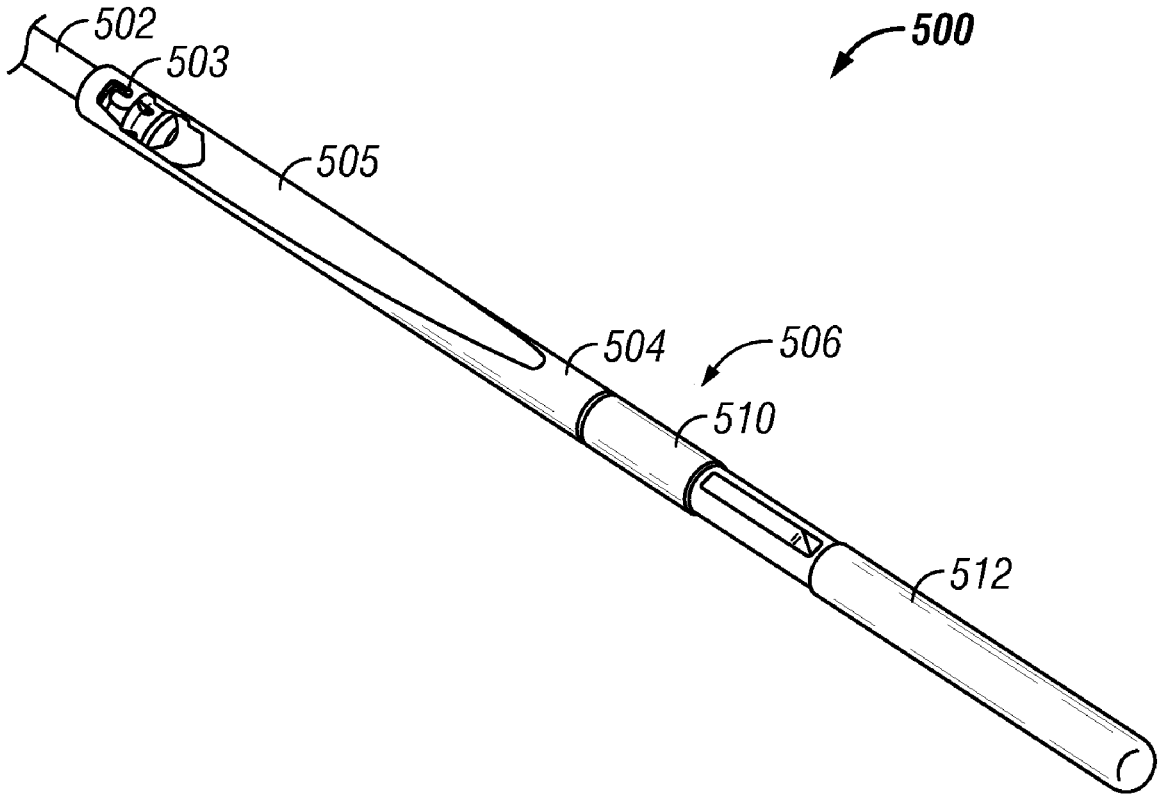
FIG. 16 is a perspective view of an alternative embodiment of a mechanical window finder system, optionally including an attached operating tool.
Figure 17A:
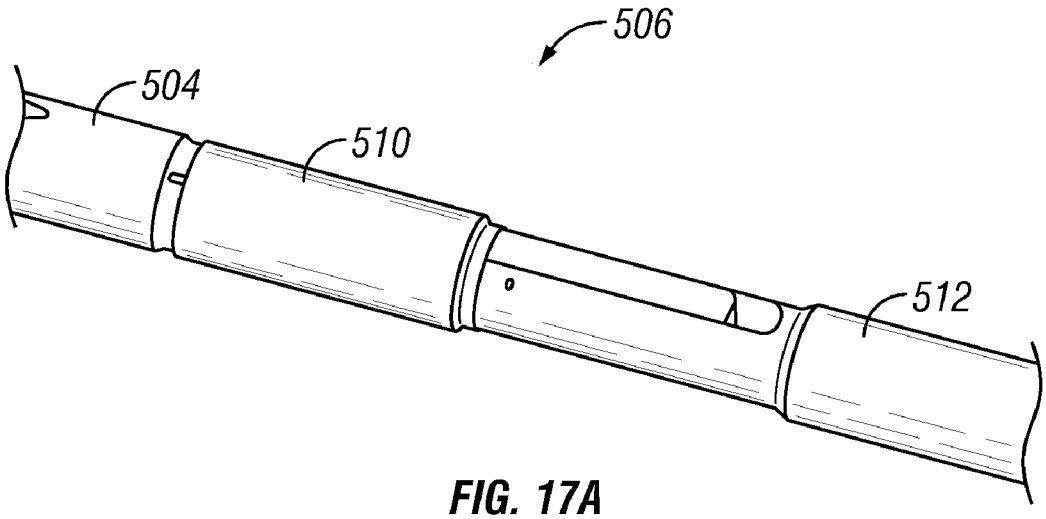
FIG. 17A is a retracted position of a window finding assembly of the system of FIG. 16.
Figure 17B:
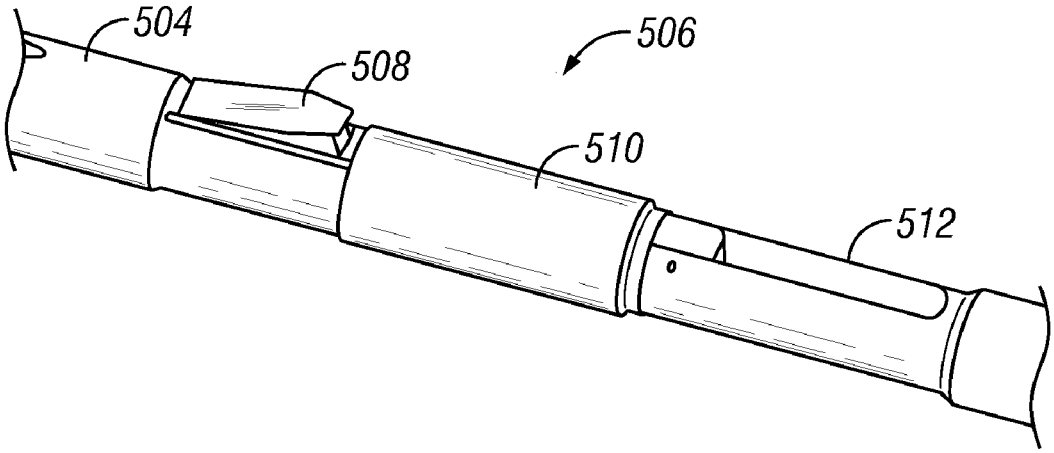
FIG. 17B is a released or extended position of the window finding assembly of FIG. 17A.
Figure 18:
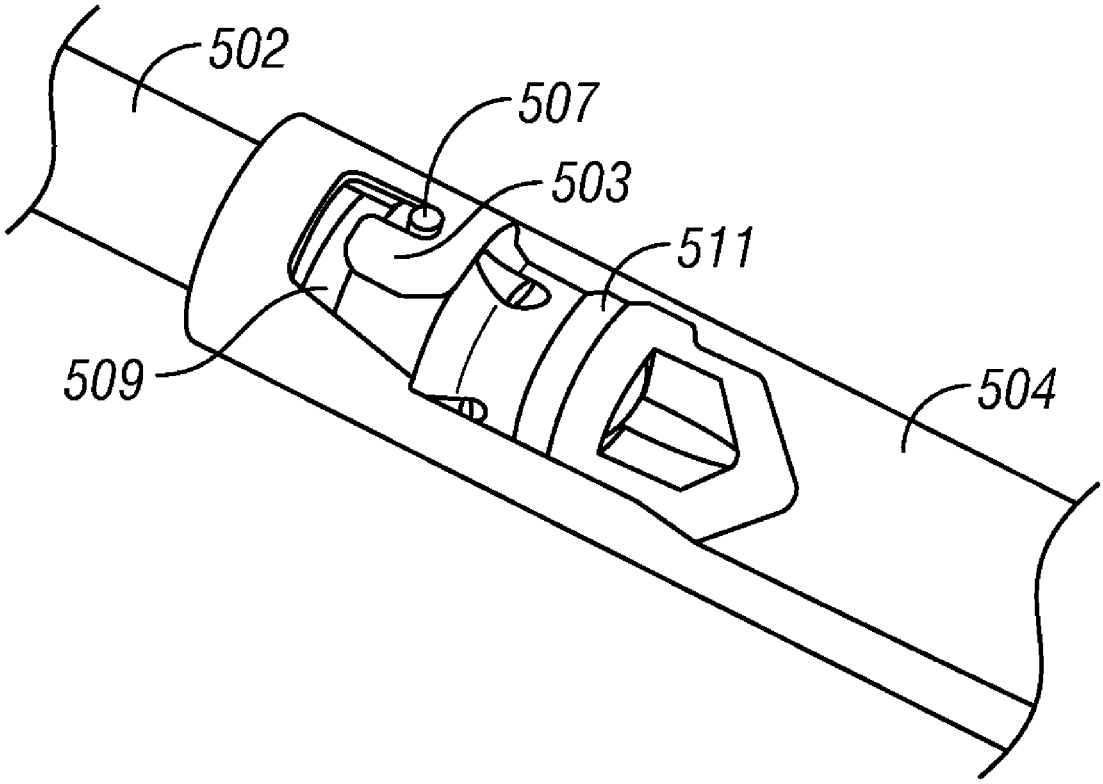
FIG. 18 is the connection between the operating tool and the window finder of FIG. 16.

In an exemplary embodiment, with reference to FIG. 16, a window finder tool 500 is completely mechanically actuated. The tool 500 includes a running tool 502 removably coupled at 503 to a deflector 504 having a ramp 505. The deflector 504 integrally includes a window finding assembly 506 including a sleeve 510 overlapping a dog 508 (see FIG. 17B). An end connector or bull nose 512 is coupled at the end of the tool 500. In operation, the tool 500 is set down on bottom hole or on a bridge plug and weight applied to shear pins in the assembly 506 and release the bull nose 512 relative to the deflector 504. The deflector 504 is then pulled upward relative to the bull nose 512 and the sleeve 510 that is coupled to the bull nose 512. The relative downward slide of the sleeve 510 exposes the finder dog 508, as shown in FIGS. 17A and 17B. Mechanical forces then extend the finder dog 508, such as by springs, consistent with the teachings herein. In some embodiments, the tool 500 is a one-trip system by virtue of attaching a washout tool or jetting assembly 502 to the deflector 504, as shown in FIG. 18, by using a coupling including a pin 507 and J-slot 509 for removing the tool 502 from the deflector 504. In use, the window finder 500 is activated by a mechanical set-down action to release the sleeve 510, followed by a mechanical upward pull to retract the sleeve 510, followed by a mechanical extension of the dog 508. The window finder and deflector 500 may be used and further manipulated as described herein.

Figure 19:
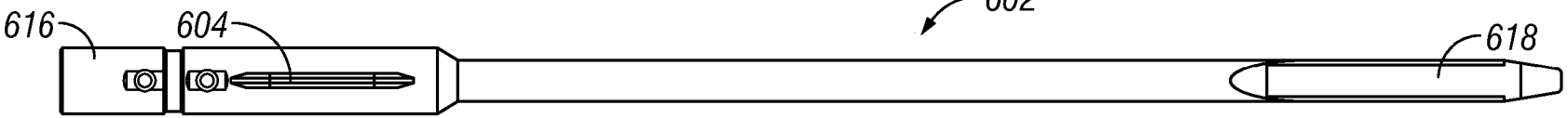
FIG. 19 is a top view of an alternative embodiment of a running and retrieval tool for embodiments of a window finder system.
Figure 19A:
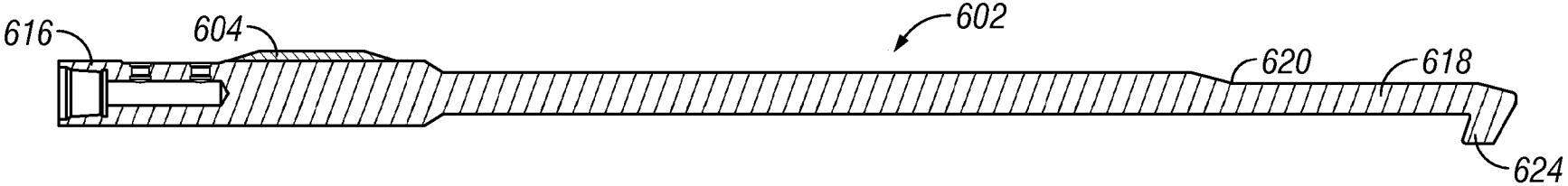
FIG. 19A is a side cross-section view of the running and retrieval tool of FIG. 19.

In other embodiments, with reference to FIGS. 19 and 19A, an alternative retrieval tool 602 includes an end 616 having a blade 604. The other end 618 includes a hook 624 and an offset 620 on the other side from the hook 624. Further, the overall axial length of the retrieval tool 602 is greater than the tool 102, and the hook 624 may extend further inward than the hook 124. The blade 604 may be used to push against the casing or borehole to increase the hooking ability of the hook 624 in difficult retrieval situations. In addition, the increased axial and hook lengths, as well as the offset improve retrieval abilities in certain situations.

In many of the embodiments herein, a deflector body includes an integral window finding assembly having an extendable window finder dog. The window finding assembly may also include a retractable sleeve retaining the dog. The dog is retained and concealed while running the tool downhole to prevent snagging. A removeable running tool includes a fluid flow path providing pressurized fluid to a fluid flow path in the deflector and window finding assembly. The pressurized fluid is used to release the sleeve so that it retracts and releases the extendable dog. In some embodiments, the tool is hydraulically activated to allow the dog to be mechanically energized radially outward. Thus, tool activation may be achieved without setting down, weighting or jarring the tool. Since the extended finder dog is integral with the deflector and aligned with the deflector ramp, the ramp is automatically aligned with the lateral borehole toward which the dog is projected. Upon removal from the borehole of the deflector and window finding assembly by the running/retrieval tool, the dog may be collapsed and the sleeve slid back and shear pinned into position in the field for re-use. In alternative embodiments, the mechanically extending dog is also released mechanically by moving the sleeve with mechanical means.

While specific embodiments have been shown and described, modifications can be made by one skilled in the art without departing from the spirit or teaching of these principles. The embodiments as described are exemplary only and are not limiting. Accordingly, the scope of protection is not limited to the embodiments described, but is only limited by the claims that follow, the scope of which shall include all equivalents of the subject matter of the claims.

What is claimed is:

1. An apparatus for finding a pre-existing downhole window comprising:

a body having a deflector ramp and a cavity; and an extendable dog disposed in the cavity, the dog mechanically moveable between a retracted position and an extended position into the pre-existing window; and an axially moveable sleeve disposed adjacent the extendable dog and configured to overlap the dog when retracted, wherein the sleeve is secured with at least one shearable fastener;

wherein the moveable sleeve is hydraulically actuatable to release the extendable dog from the retracted position to the extended position.

2. The apparatus of claim 1, wherein the sleeve overlaps a portion of the extendable dog in a first position when the extendable dog is in the retracted position, and is displaced from the extendable dog in a second position when the extendable dog is in the extended position.

3. The apparatus of claim 1 wherein the extendable dog is aligned with the deflector ramp.

4. The apparatus of claim 3 wherein the deflector ramp is aligned with the pre-existing window and a lateral borehole when the extendable dog is in the extended position.

5. The apparatus of claim 1 further comprising a running tool removably coupled to the body.

6. A one-trip system comprising the apparatus of claim 1 removably coupled to an operating tool.

7. The system of claim 6 wherein the operating tool is a washout tool.

8. A downhole window finding apparatus comprising:

a deflector including a window finding assembly; and a running tool removably coupled to the deflector;

wherein the window finding assembly comprises:

an extendable member; and an axially moveable sleeve retaining the extendable member; and a shear bolt configured to removably couple the running tool to the deflector;

wherein the shear bolt includes a fluid passage fluidicly coupling a flow line in the running tool to a flow line in the deflector.

9. The apparatus of claim 8 wherein the sleeve overlaps and retains the extendable member in a first position, and releases the extendable member in a second position.

10. The apparatus of claim 9 wherein the sleeve is hydraulically actuated from the first position to the second position.

11. The apparatus of claim 9 wherein a mechanical force moves the extendable member from a retracted position to an extended position when the sleeve in the second position.

12. The apparatus of claim 11 wherein a spring provides the mechanical extending force.

13. The apparatus of claim 8 further comprising a fluid flow path extending through the running tool and the deflector to the window finding assembly.

14. The apparatus of claim 13 wherein the fluid flow path is occupied by water.

15. The apparatus of claim 13 wherein the fluid flow path is adapted to receive a pressurized fluid.

16. A method of finding a pre-existing downhole window comprising:

disposing a deflector including a ramp aligned with an integral extendable dog in a borehole having the pre-existing window;

providing the dog in a retracted position having an axially moveable sleeve overlapping a nose of the dog;

running the deflector to a position near the pre-existing window;

shearing at least one fastener and hydraulically actuating and translating the sleeve downward axially away from the dog;

exposing the nose of the dog and mechanically extending the dog;

moving the deflector until the dog sets in the pre-existing window; and automatically aligning the deflector ramp with the pre-existing window by setting the dog in the pre-existing window.

17. The method of claim 16 further comprising receiving a weight indication that the dog is set in the pre-existing window.

18. The method of claim 16 further comprising rotating the deflector and receiving a torque indication that the dog is set in the pre-existing window in response to the rotating.

19. The method of claim 16 further comprising:

removably coupling a running tool to the deflector;

flowing a fluid through the running tool and the deflector to pressurize the sleeve; and actuating the sleeve to release the extendable dog.

20. The method of claim 19 further comprising shearing the running tool from the deflector and removing the running tool from the borehole.

21. The method of claim 20 further comprising re-entering the borehole with the running tool and retrieving the deflector.

22. The method of claim 21 wherein the running tool includes a blade and an offset hook.

23. The method of claim 16 further comprising:

collapsing the dog;

moving the deflector in the borehole; and re-extending the finder dog to determine at least one of an orientation of the window or a length of the window.

* * * * *